US005800366A

United States Patent [19]

Bertrand

[11] Patent Number: 5,800,366

[45] Date of Patent: Sep. 1, 1998

[54] TORSO TRAINER

[76] Inventor: Scott R. Bertrand, 3433B Main St., College Park, Ga. 30337

[21] Appl. No.: 701,652

[22] Filed: Aug. 26, 1996

[51] Int. Cl.[6] ..... A61H 1/00

[52] U.S. Cl. ..... 601/24; 601/23; 601/26; 482/144; 434/38; 434/55

[58] Field of Search ..... 601/5, 23, 24, 601/26, 33–35, 86, 90, 98; 482/95, 96, 110, 131, 139, 144, 148, 907; 128/845, 878; 472/29, 40, 41, 44, 47; 5/607–609, 621, 624; 434/38, 55

[56] References Cited

U.S. PATENT DOCUMENTS

| | | | |
|---|---|---|---|
| 1,342,871 | 6/1920 | Ruggles | 434/55 |
| 1,393,456 | 10/1921 | Ruggles | 434/38 |
| 2,487,730 | 11/1949 | Robb | 601/24 |
| 3,089,692 | 5/1963 | Blomquist | 601/24 |
| 3,378,259 | 4/1968 | Kupchinski . | |
| 3,567,218 | 3/1971 | Johnson . | |
| 3,936,047 | 2/1976 | Brandt et al. | 482/146 |
| 4,113,250 | 9/1978 | Davis | 601/23 |
| 4,194,500 | 3/1980 | Grimaldi . | |
| 4,214,790 | 7/1980 | Sieber . | |
| 4,356,577 | 11/1982 | Taylor et al. | 601/90 |
| 4,438,761 | 3/1984 | McGowen | 482/144 |
| 4,511,137 | 4/1985 | Jones . | |
| 4,546,967 | 10/1985 | Kecala . | |
| 5,275,132 | 1/1994 | Oloff | 434/55 |

FOREIGN PATENT DOCUMENTS

| | | | |
|---|---|---|---|
| 211200 | 2/1987 | European Pat. Off. | 482/146 |

*Primary Examiner*—Jeanne M. Clark
*Attorney, Agent, or Firm*—John L. James

[57] ABSTRACT

A torso trainer has a user platform mounted on a pivoting, rotating shaft. The lower torso of the user is strapped to the platform with the upper torso supported by the user who employs the waistline muscles. As the platform rotates, different muscle groups are worked so that during the course of a complete 360° revolution all the waistline muscles are exercised. The user effort required varies with the degree of tilting of the shaft and platform. At a nearly vertical tilting position user effort is minimal, while, at a horizontal tilting position, user effort is maximum. A user hand control starts platform rotation and overrides the stopping of platform rotation so that there can be multiple rotations.

7 Claims, 5 Drawing Sheets

TORSO TRAINER

TECHNICAL FIELD OF THE INVENTION

The present invention relates generally to physical therapy and exercise equipment, and, more particularly, to a an apparatus for exercising and training the waistline and muscle groups supporting the spinal column.

BACKGROUND OF THE INVENTION

Millions of work days are lost each year because of back injuries. Numerous pieces of equipment have been constructed to address the concern about back injuries. Conventional equipment attempts to condition the injured lower back by applying the same stress that often caused the initial injury. Naturally, this prevents the equipment from achieving its goal of helping a worker return to the work force. A large percentage of workers with back injuries never recover sufficiently to return to work performing their former job tasks. Rehabilitative lower back exercises must avoid lumber flexion type movements such as those caused by sit-ups, abdominal cam machines, crunches, leg lifts, and dead lift type movements. Rehabilitative lower back exercises must also avoid lumbar extension type movements such as those caused by hyperextension, low back cam machines, or hip and back flexor type machines. These motions can cause a shearing of the intervertebral discs and can also exert posterior pressure or anterior pressure on the discs causing bulging into an area of the disc that has been injured creating significant irritation and pain. Accordingly, it will be appreciated that it would be highly desirable to have an apparatus that exercises all waistline muscle groups while avoiding harmful motions.

It is desirable to be physically fit and to have a healthy and youthful appearance. A major factor in a physically fit appearance is a trim waistline without a stomach bulge. The abdominal musculature, an anterior muscle group, accounts for only about a quarter of the waistline muscles, yet more than three quarters of all waistline exercises emphasize this anterior muscle group. This emphasis creates a lack of balance and coordination with adjacent or opposing muscle groups which can cause pain and physical damage. Accordingly, it will be appreciated that it would be highly desirable to have an apparatus that exercises all waistline muscle groups.

SUMMARY OF THE INVENTION

The present invention is directed to overcoming one or more of the problems set forth above. Briefly summarized, according to one aspect of the present invention, an apparatus comprises a base having a horizontally extending axis, a housing mounted on the base, a rotatable shaft extending from the housing and being vertically pivotally movable toward and from the base, and a platform mounted on the shaft.

The lower torso of the user is strapped to the platform with the upper torso supported by the user who employs the waistline muscles. As the platform rotates, different muscle groups are worked so that during the course of a complete 360° revolution all the waistline muscles are exercised. The user effort required varies with the degree of tilting of the shaft and platform. At a nearly vertical tilting position user effort is minimal, while, at a horizontal tilting position, user effort is maximum.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
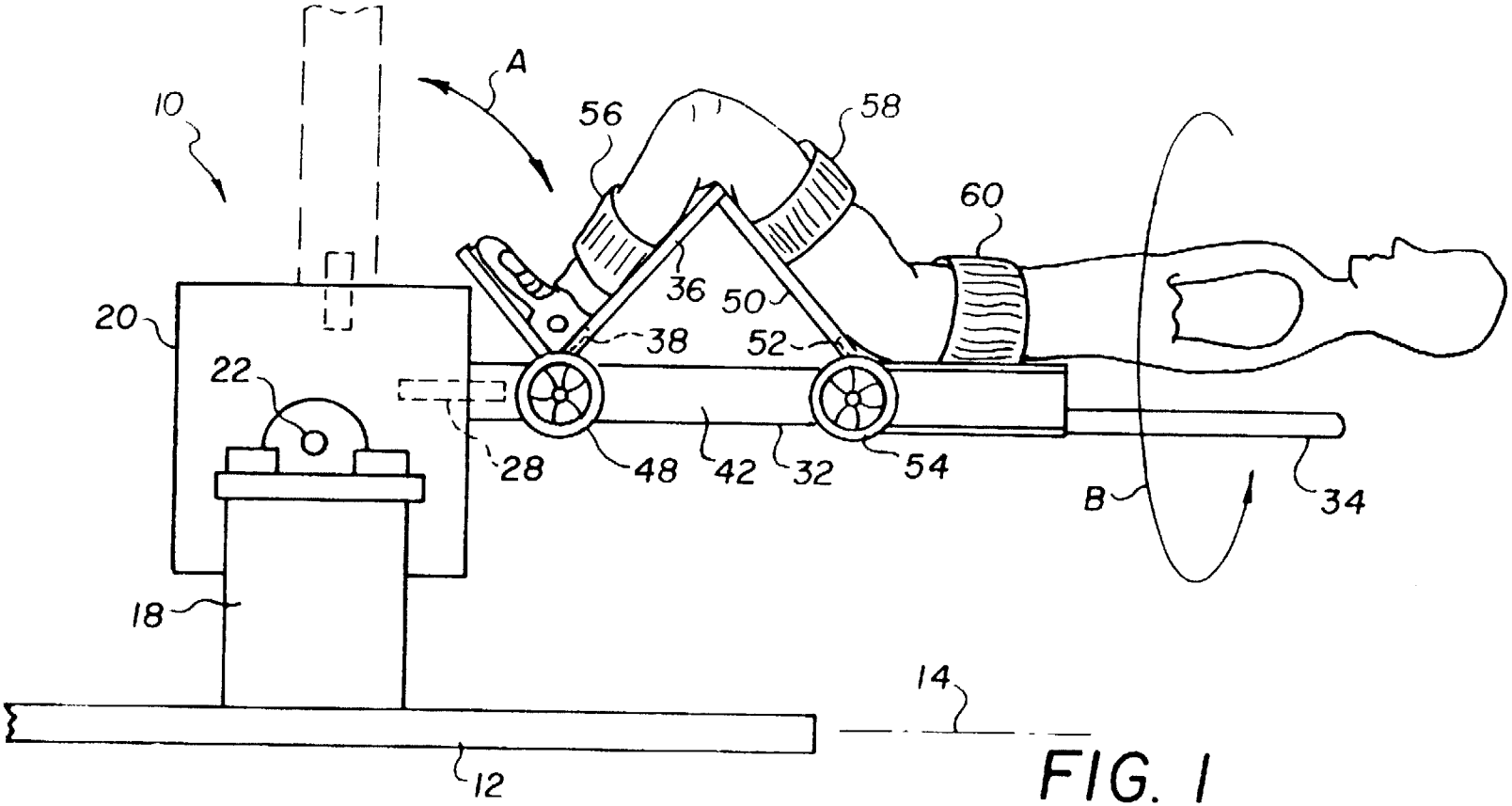
FIG. 1 is a diagrammatic side view of a preferred embodiment of a torso trainer with a user platform according to the present invention.
Figure 2:
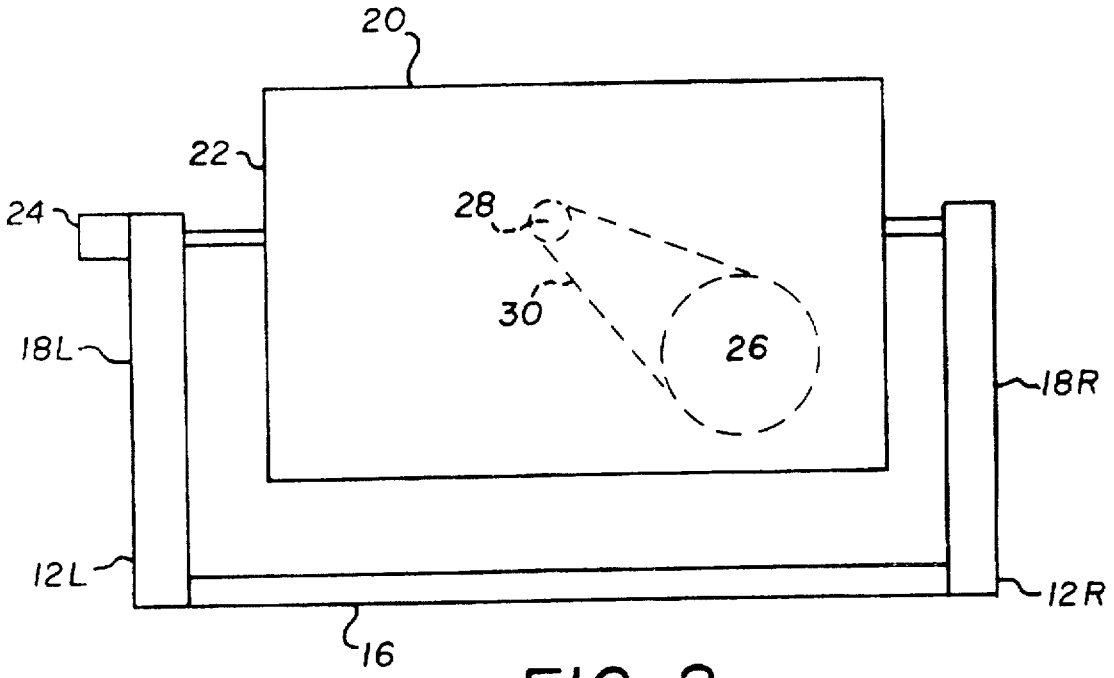
FIG. 2 is a diagrammatic left end view of the torso trainer of FIG. 1.

Referring to FIGS. 1–4, a torso trainer 10 has a base 12 with a longitudinal axis 14 extending horizontally. The base 12 is mounted on the floor of an exercise room or physical therapy room. The base may be fastened to the floor by bolts or the like, or may extend horizontally a sufficient distance to assure stability without mechanical fasteners. The base includes one or more cross members 16 extending between the longitudinal members 12L, 12R. The base 12 also includes an upright member 18. Preferably there are a pair of upright members 18L, 18R spaced apart from one another to increase lateral stability.

A housing 20 is mounted on the upright members 18 of the base 12 and pivots about a pivot 22 that rests the housing 20 on the upright members 18. The housing pivots between a horizontal position and a vertical position as indicated by arrow A. The pivoting may be accomplished electrically with a motor or manually using a manually operated worm gear 24. A hand cranked worm gear 24 is preferable because of its relative simplicity and absence of electrical hazard. Also, there is no need to change the angle after a user begins an exercise regimen.

A shaft 28 extends from the housing 20 and is vertically pivotal with the housing 20 so that it also moves between a horizontal position and a vertical position toward and from the base 12. Alternatively, the housing 20 may be stationary with the shaft 28 pivoting between the vertical and horizontal positions. It is preferable to pivot the housing so that the mass of the housing counterbalances the mass of the user. The shaft 28 is rotatable by a motor 26 a fall 360° as indicated by arrow B. Power is transferred from the motor 26 to the shaft 28 via a drive belt 30 or through gears. The drive belt 30 is preferred over gears because of its relative simplicity and ease of maintenance.

A platform 32 is mounted on the shaft so that it rotates and pivots with the shaft. The platform 32 includes a support member 34 that extends from the platform 32 to engage and support a user's back to prevent overarching of the back. During use, the user's back is ordinarily spaced from the back support member 34 as the user exercises the waist muscles. The back support stands ready if the user tires or otherwise cannot maintain his erect position.

The user is releasably attached to the platform 32 to prevent the user from falling as the platform rotates through positions where the platform is at a higher elevation than the user and other positions where the platform does not support the user. The apparatus for attaching the user includes a first brace member 36 that has first and second opposed side portions and first and second end portions. The second end portion defines an elongated slot 38 along each of the side portions that is alignable with a corresponding bore 40 in a rail 42 of the platform 32. A releasable fastener 44 extends through the aligned slot 38 and bore 40 to adjustably fasten the first brace member 36 to the platform 32. The fastener 44 may simply be a threaded bolt 46 mateable with a nut with a large head in the form of a hand wheel 48 to facilitate easily adjusting the brace member 36 to accommodate users with longer or shorter legs. Similarly, a second brace member 50 has first and second opposed side portions and first and second end portions. The second end portion defines an elongated slot 52 along each of the side portions that is alignable with a corresponding bore in the rail 42 of the platform 32. A releasable fastener 54 extends through the aligned slot and bore to adjustably fasten the second brace member 50 to the platform 32.

The first end portions of the first and second brace members 36, 50 are pivotally connected to one another. The user lies on the platform with his calves resting on the first brace member 36 and his thighs resting on the second brace member 50 with his knees above the pivot point connecting the brace members. The pivotal connection of the first and second brace members accommodates legs of varying lengths comfortably. Ankle straps 56 attached to the first brace member 36 are used to secure the user's ankles to the first brace member. An ankle strap may be in the form belt with a buckle and eyelets, or, more preferably, is formed of strips of webbing, leather or other strong material containing hook and loop fasteners. Thigh straps 58 attached to the second brace member 50 hold the thighs in position on the second brace member. Similarly, a waist strap 60 attached to the platform 32 fits about the user's hips to hold the user to the platform. One material suitable the straps is the material used for automobile seat belts. The material may be padded as desired for increased user comfort.

Figure 5:
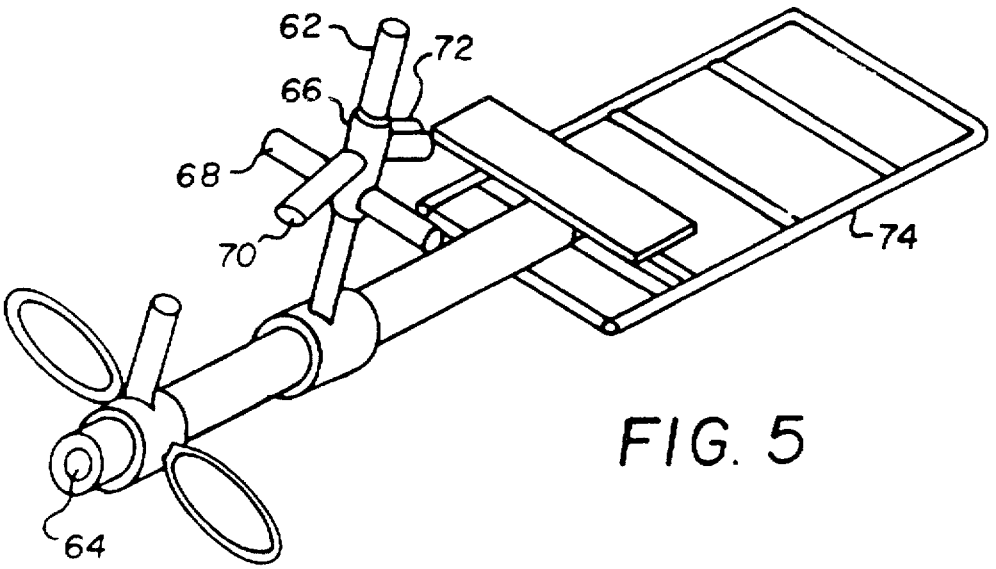
FIG. 5 is perspective view of another preferred embodiment of a user platform for a torso trainer.
Figure 3:
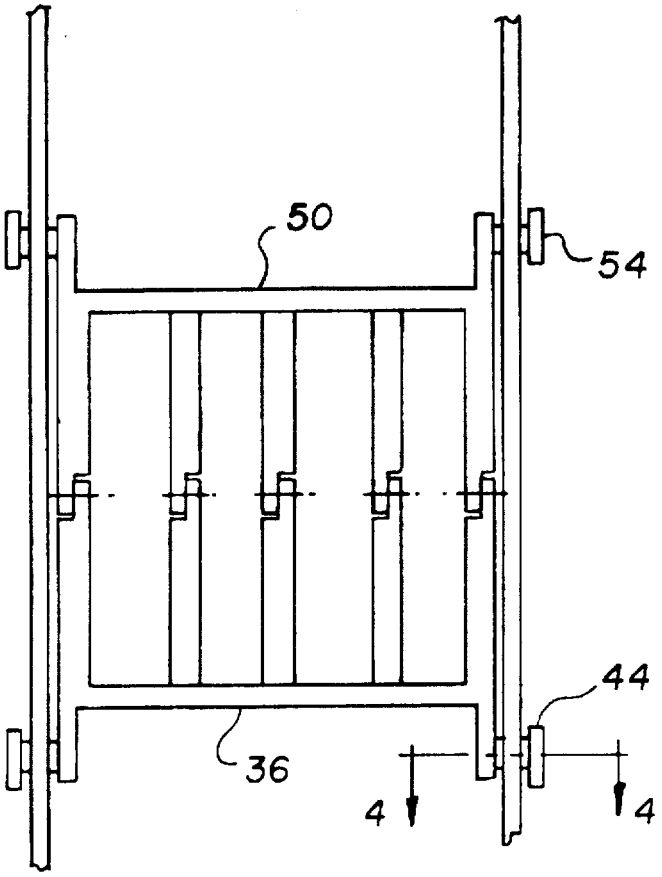
FIG. 3 is a diagrammatic top view of the user platform for the torso trainer of FIGS. 1 and 2.
Figure 4:
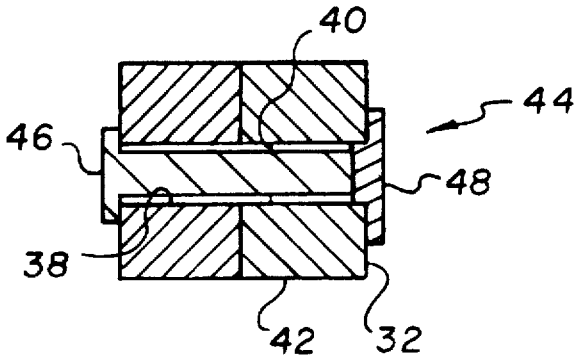
FIG. 4 is a sectional view taken along line 4—4 of FIG. 3.
Figure 6:
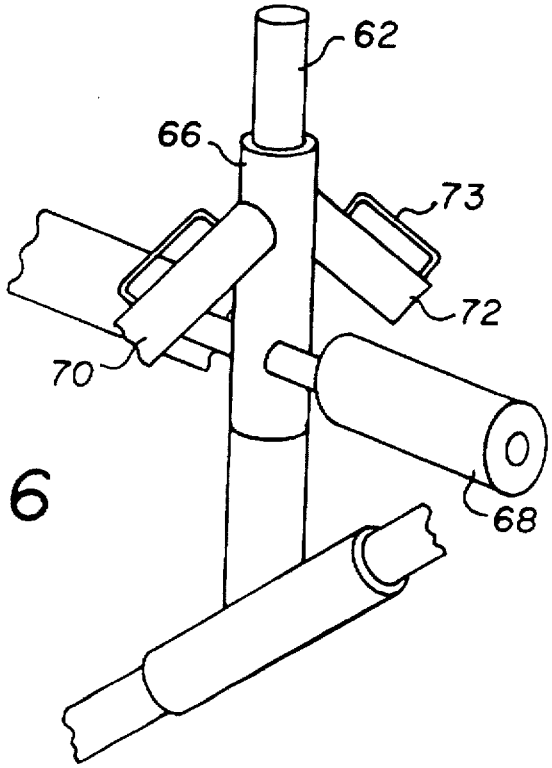
FIG. 6 is a somewhat enlarged perspective view of the supporting brace structure of FIG. 5.
Figure 7:
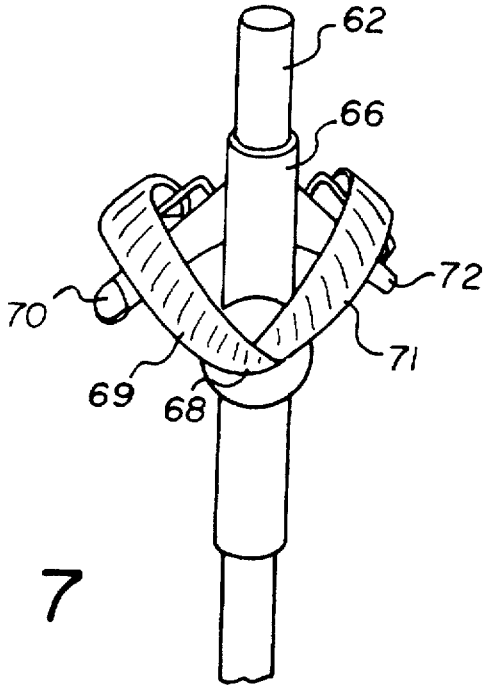
FIG. 7 is a diagrammatic side view of the supporting brace of FIG. 6.

Referring now to FIGS. 5–7, another platform and apparatus for attaching the user to the platform is illustrated. The apparatus includes an elongated brace member 62 extending perpendicular to the shaft 64. A hub 66 is movably mounted on the brace member 62 and is movable up and down the brace member to accommodate legs of varying lengths. A first padded cross member 68 protrudes from the hub 66 and extends perpendicular to the brace member 62 and to the shaft 64 for receiving the user's legs. The posterior portion of the user's knees rest on the cross member 68. A leg strap 69 attached to a second cross member 70 is also attached to the hub 66 for securing the user's upper shin area below the knee to the cross members 68, 70. A thigh strap 71 attached to cross member 72 is also attached to the hub 66 to secure the user's thighs to the cross members 68, 70. A handle 73 may be attached to cross member 72 to assist the user in maintaining his position away from the back brace 74.

Figure 8:
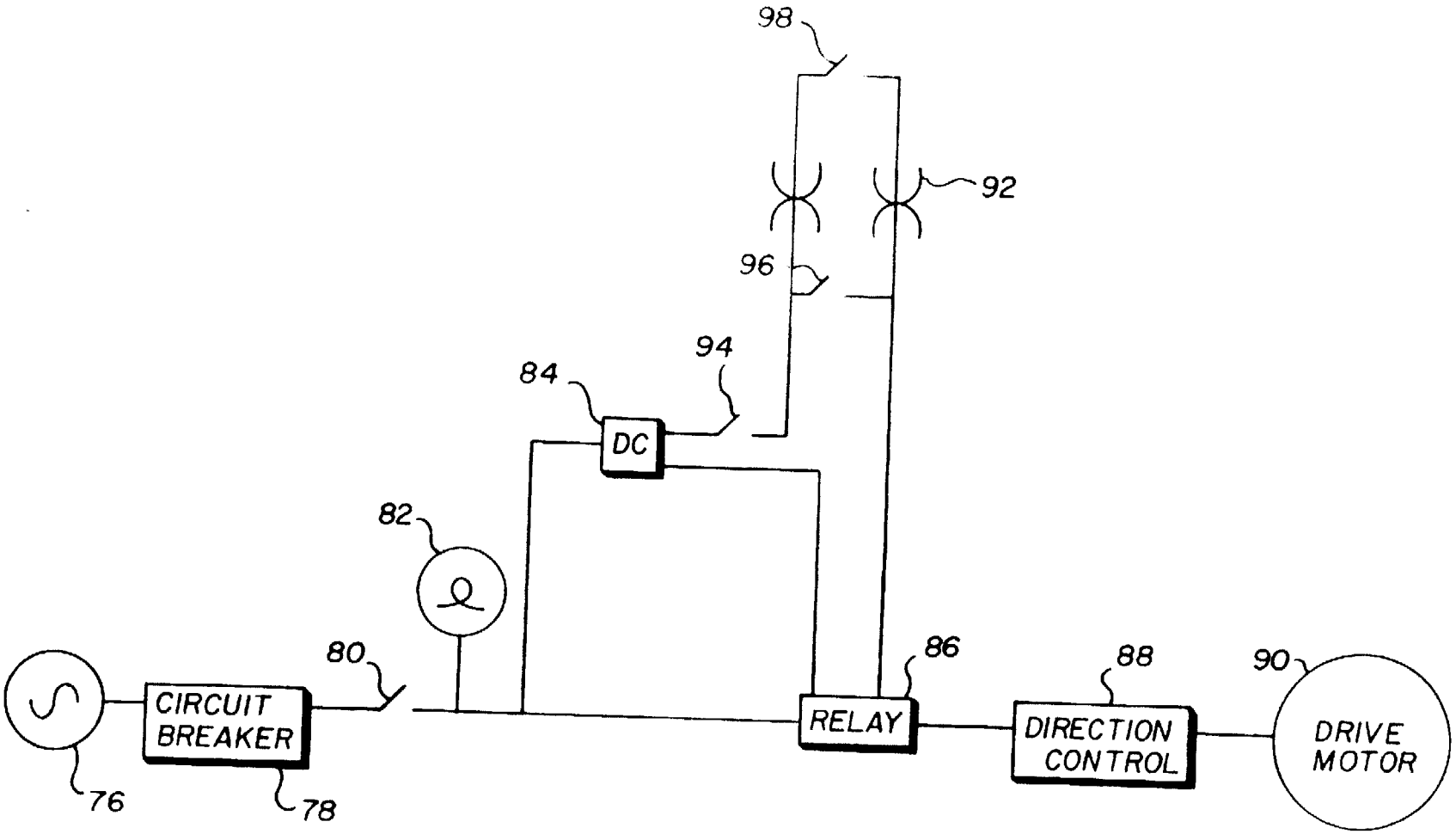
FIG. 8 is a block diagram of a motor and controls for the torso trainer of FIG. 1.

Referring to FIG. 8, power from a power source 76 is input to the torso trainer which is protected from electrical faults by a circuit breaker 78. The power flow is controlled by a switch 80, preferably mounted on the torso trainer unit, that is readily accessible to the user. A light 82 located on the unit indicates the status of the unit. When the light is on, the power to the unit is on, and when the light is off, the power to the unit is off. The power follows two parallel circuits. One circuit is to a transformer isolated low voltage DC source 84, and the other circuit is to a solid state relay 86. The solid state relay 86 is the main switch that controls the current to the rotational directional control switch 88 through which the current to the drive motor 90 flows. The drive motor 90 is the rotational motor that turns the shaft and platform. The rotational direction control switch 88 allows the user to select a clockwise shaft rotation or a counter-clockwise rotation. Preferably, the drive motor 90 can drive the platform at a number of different slow speeds on the order of one to ten minutes per revolution, but other speeds can be used.

The transformer isolated low voltage DC source 84 is used to isolate and protect the user from the higher voltage from the power source 76 and to reduce the voltage and current at the slip ring assembly 92. The DC source 84 supplies the current and voltage to the control switches, 94, 96, 98 that monitor system safety parameters and user input commands. Two of the switches 94, 96, monitor safety parameters and the other switch 98 is used by the user for input commands. The angle safety switch 94 monitors the tilt angle of the unit and inhibits the power to the drive motor 90 if it detects that the shaft is at an unsafe angle. An unsafe angle is an angle more than 90° from vertical which places the platform and user attached to it tilting downward head first. The desired pivotal angle of the shaft and platform is 90° so that the shaft and platform move between vertical and horizontal positions. The switch 94 overrides all other control switches. If the pivot angle is less than 90°, the switch 94 is closed, but if the pivot angle is greater than 90°, the switch is open. When open, switch 94 inhibits current flow to the solid state relay 86 and holds the relay 86 in the off state so that the drive motor 90 is off and does not rotate the shaft.

The rotation position switch 96 monitors the orientation of the platform and causes the drive motor 90 to continue its rotation until the platform is at its top position. The top position in which it is safest and easiest to enter or exit the unit. When the switch 96 detects that the platform is in the up position, it opens to stop current flow to the relay 86 and de-energize the drive motor to stop platform rotation. If the switch detects that the platform is not in the up position, it closes or remains closed to turn on the relay and drive motor to rotate or continue rotation of the user platform.

The hand control switch 98 will override the open, nonconducting state of the rotation position switch 96 and allow the user to rotate past the up position and continue through another complete revolution of the platform. Because the user holds the hand switch 98 and is rotating with the platform, the electrical connections to this switch 98 are made via the slip ring assembly 92. When the user desires to start a rotation or desires to continue rotating past the up position, the user holds the switch 98 closed. This will override the rotation position switch 96 and enable the relay and drive motor. If the user desires to end the rotational cycle, the hand switch is left open so that rotation remains under control of the rotation position switch 96.

Operation of the present invention is believed to be apparent from the foregoing description, but a few words will be added for emphasis. Before mounting the platform, a user selects the degree of platform tilt by turning the hand crank or the worm gear. A recuperating user or weak user should start at the vertical tilt because it is the least strenuous. As the user gets stronger, the tilt can be changed from vertical toward horizontal. A strong user will have the platform in the horizontal position and use the hand switch to do several revolutions. A more strenuous workout is obtainable by decreasing the speed of platform rotation.

Once the platform is mounted, ankle, thigh and waist straps are applied to hold the user to the platform. At this point, the platform is in its up position so that the rotation position switch is open to prevent platform rotation. When ready, the hand switch is operated to begin rotation, then released. Rotation stops after one revolution. Operating the hand switch will allow additional revolutions as desired. If the platform tilt is set below horizontal so that the user's head is lower than the feet, the angle safety switch will prevent platform rotation.

It can now be appreciated that a torso trainer has been presented. The torso trainer has a user platform mounted on a pivoting, rotating shaft. The lower torso of the user is strapped to the platform with the upper torso supported by the user who employs the waistline muscles. It trains a high percentage of the often neglected and under trained muscle fibers of the entire waistline in only a few minutes a day. The torso trainer employs the natural stress of gravity to the muscles designed to resist this force. It specifically trains the muscles of the waist girdle and, as additional benefit, all the spinal postural muscles as well. The torso trainer utilizes the weight of the user's body as a natural form of resistance. It does not rely on a user's ability to move a certain stack of weights, compress cylinders, or stretch rubber bands.

The torso trainer is a therapeutic machine that accommodates all levels of injury from minor muscle strains to more significant disc herniations and can be used within a few days of back surgery. Because the torso trainer avoids painful or harmful motions, patients eagerly use the machine. A successful workout can be done in short time on the order of ten to fifteen minutes or so.

As is evident from the foregoing description, certain aspects of the invention are not limited to the particular details of the examples illustrated. For example, the upper torso may be supported and the lower torso left unsupported while exercising the waist muscles. It is therefore contemplated that other modifications and applications will occur to those skilled the art. It is accordingly intended that the claims shall cover all such modifications and applications as do not depart from the true spirit and scope of the invention.

What is claimed is:

1. An apparatus, comprising:

a base having a horizontally extending axis;

a housing mounted on said base;

a rotatable shaft extending from said housing and being vertically pivotally movable toward and from said base;

means for rotating said shaft;

means for pivoting said shaft;

a platform mounted on said shaft pivoting and rotating with said shaft, said platform having a back brace adapted to engage and support a user's back and thereby prevent overarching the back as said platform rotates; and means for attaching the user to said platform wherein said means for attaching includes:

an elongated brace member attached to said shaft and extending perpendicular to said shaft;

a hub movably mounted on said brace member; and a pair of ankle straps attached to said hub.

2. An apparatus, as set forth in claim 1, including a user operated control switch electrically connected to said motor for selectively controlling power to said motor and thereby controlling rotation of said platform.

3. An apparatus, as set forth in claim 1, including a switch electrically connected to said motor to controllably interrupt power to the motor so said shaft does not rotate when said shaft is oriented at an angle outside of a range of zero to ninety degrees, where zero degrees corresponds to vertical orientation of the shaft and ninety degrees corresponds to horizontal orientation of the shaft.

4. An apparatus, comprising:

a base having a horizontally extending axis:

a housing mounted on said base;

a rotatable shaft extending from said housing and being vertically pivotally movable toward and from said base;

means for rotating said shaft;

means for pivoting said shaft;

a platform mounted on said shaft pivoting and rotating with said shaft, said platform having a support member extending from said platform for engaging and supporting a user's back to prevent overarching the back as said platform rotates; and means for attaching the user to said platform, said attaching means including:

an elongated brace member attached to said shaft and extending perpendicular to said shaft;

a first hub movably mounted on said brace member; and a cross member protruding from said hub and extending perpendicular to said brace member and said shaft.

5. An apparatus, as set forth in claim 4, wherein said attaching means includes thigh straps attached to said first hub.

6. An apparatus, as set forth in claim 4, wherein said attaching means includes a second hub mounted on said shaft and ankle straps attached to said second hub.

7. An apparatus, comprising:

a base;

a housing mounted on said base and being pivotally movable toward and from said base;

means for pivoting said housing on said base;

a shaft extending from said housing and pivoting with said housing;

a motor mounted in said housing rotating said shaft through a drive belt connecting said shaft and said motor; and a platform mounted on said shaft having attaching means for attaching the user to said platform, said platform pivoting and rotating with said shaft, said attaching means including:

a first brace attached to said shaft and extending perpendicular to said shaft;

a first hub movably mounted on said first brace;

a cross member protruding from said first hub and extending perpendicular to said first brace and said shaft;

a second brace attached to said shaft and extending perpendicular to said shaft;

a second hub movably mounted on said second brace; and a pair of ankle straps attached to said second hub.

* * * * *